US006470508B2

(12) United States Patent
Turner

(10) Patent No.: US 6,470,508 B2
(45) Date of Patent: Oct. 29, 2002

(54) AIR CHECK VALVE SYSTEM FOR A SPA

(75) Inventor: Denis P. Turner, Oceanside, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

(21) Appl. No.: 09/866,249

(22) Filed: May 25, 2001

(65) Prior Publication Data

US 2002/0053106 A1 May 9, 2002

Related U.S. Application Data

(60) Provisional application No. 60/246,835, filed on Nov. 8, 2000.

(51) Int. Cl.[7] ..... E04H 4/12
(52) U.S. Cl. ..... 4/541.1; 4/492; 4/509
(58) Field of Search ..... 4/541.1–541.6, 4/492, 493, 509

(56) References Cited

U.S. PATENT DOCUMENTS 4,057,372 A * 11/1977 Johnson et al.
4,115,878 A * 9/1978 Johnson et al.
4,189,791 A * 2/1980 Dundas
4,773,104 A * 9/1988 Wang
4,858,255 A * 8/1989 Haisman ..... 4/541.4
5,153,949 A * 10/1992 Karlsson ..... 4/541.4

* cited by examiner

*Primary Examiner*—Charles R. Eloshway
(74) *Attorney, Agent, or Firm*—Price and Gess

(57) ABSTRACT

A system for use in a spa for controlling air flow to jets of the spa having a water pump directing water to a water input of a jet nozzle; and a valve directing exhaust air from the water pump to an air input of the jet nozzle, the valve being operated by a vacuum generated at the intake of the water pump, whereby when the water pump is operating and pumping water to the jet nozzle, the valve is opened for directing the exhaust air from the water pump to the jet nozzle. The valve is an air-check valve that has a piston for closing the valve under spring pressure and operative in response to a vacuum for overcoming the spring pressure so as to open the valve.

14 Claims, 3 Drawing Sheets

AIR CHECK VALVE SYSTEM FOR A SPA

CROSS-REFERENCE TO RELATED APPLICATION

This application claims the benefit of U.S. Provisional U.S. patent application Ser. No. 60/246,835 entitled, filed Nov. 8, 2000.

BACKGROUND OF THE INVENTION

1. Field of the Invention

The present invention relates to an apparatus for use in a spa system for controlling air flow to all jets of the spa.

2. Description of Related Art

Prior art spa systems employ heaters and air pumps to energize jets to the spa. Such systems usually employed a separate air pump and heater to create the hot air for use with water to inject into jets for the spa. These prior art systems employed a multi-check valve system to control the air intake to each individual jet. Air injection was applied by a "Venturi" effect at the jet body at an environmental temperature.

Therefore, a need exists for a more efficient apparatus and system for injecting heated air into spa jets.

SUMMARY OF THE INVENTION

These and other objects, which will become apparent as the invention is described in detail below, are provided by a system for use in a spa for controlling air flow to jets of the spa having a water pump directing water to a water input of a jet nozzle; and a valve directing exhaust air from the water pump to an air input of the jet nozzle, the valve being operated by a vacuum generated at the intake of the water pump, whereby when the water pump is operating and pumping water to the jet nozzle, the valve is opened for directing the exhaust air from the water pump to the jet nozzle. The valve is an air-check valve that has a piston for closing the valve under spring pressure and operative in response to a vacuum for overcoming the spring pressure so as to open the valve.

It is an object of the present invention to provide an air check valve that is self-cleaning with a built-in debris collecting multi-chaser.

Another object of the present invention is to provide a positive sealing air check valve with spring/air assistance.

Still another object of the present invention is to provide an air check valve with a floating-rotating piston, which prevents friction and the development of a ware pattern.

Yet another object of the present invention is to provide an air check valve with a vacuum chamber in order to prevent pump cavitation.

A feature of the present invention is that the air check valve helps provide an energy efficient spa system in which the pre-heated air from a water pump exhaust may be directed to the spa jets.

Another feature of the present invention is that the disclosed air-check valve is vacuum-activated and adjustable.

Still another feature of the present invention is that it includes a built-in glue trap in both the intake and exhaust passages.

Still other objects, features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims. The present invention will become apparent when taken in conjunction with the following description and attached drawings, wherein like characters indicate like parts, and which drawings form a part of this application.

BRIEF DESCRIPTION OF THE DRAWINGS

The general purpose of this invention, as well as a preferred mode of use, its objects and advantages will best be understood by reference to the following detailed description of an illustrative embodiment with reference to the accompanying drawings in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an apparatus for use in a spa system for controlling air flow to jets of the spa.

Figure 1:
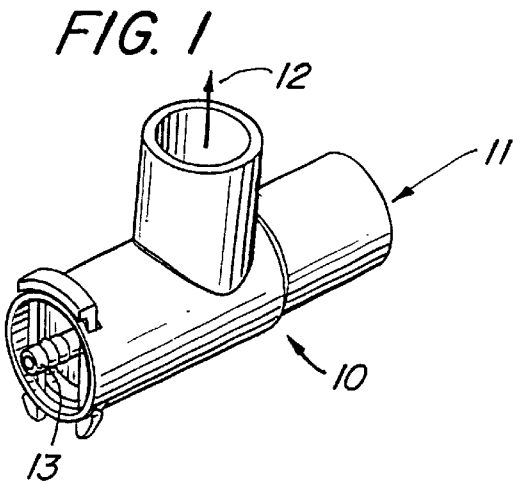
FIG. 1 illustrates a perspective view of the valve of the present invention.

Referring now to the drawings and FIG. 1 in particular, valve 10 of the present invention is shown in a perspective view. Pressurized air is provided at an intake 11 and, when the valve is open, the pressurized air is released at an exhaust 12. The valve is operated by applying a vacuum to a tap 13 of at least 70 to 80 inches of water for a single pump (100 to 120 inches of water for a dual pump).

Figure 2:
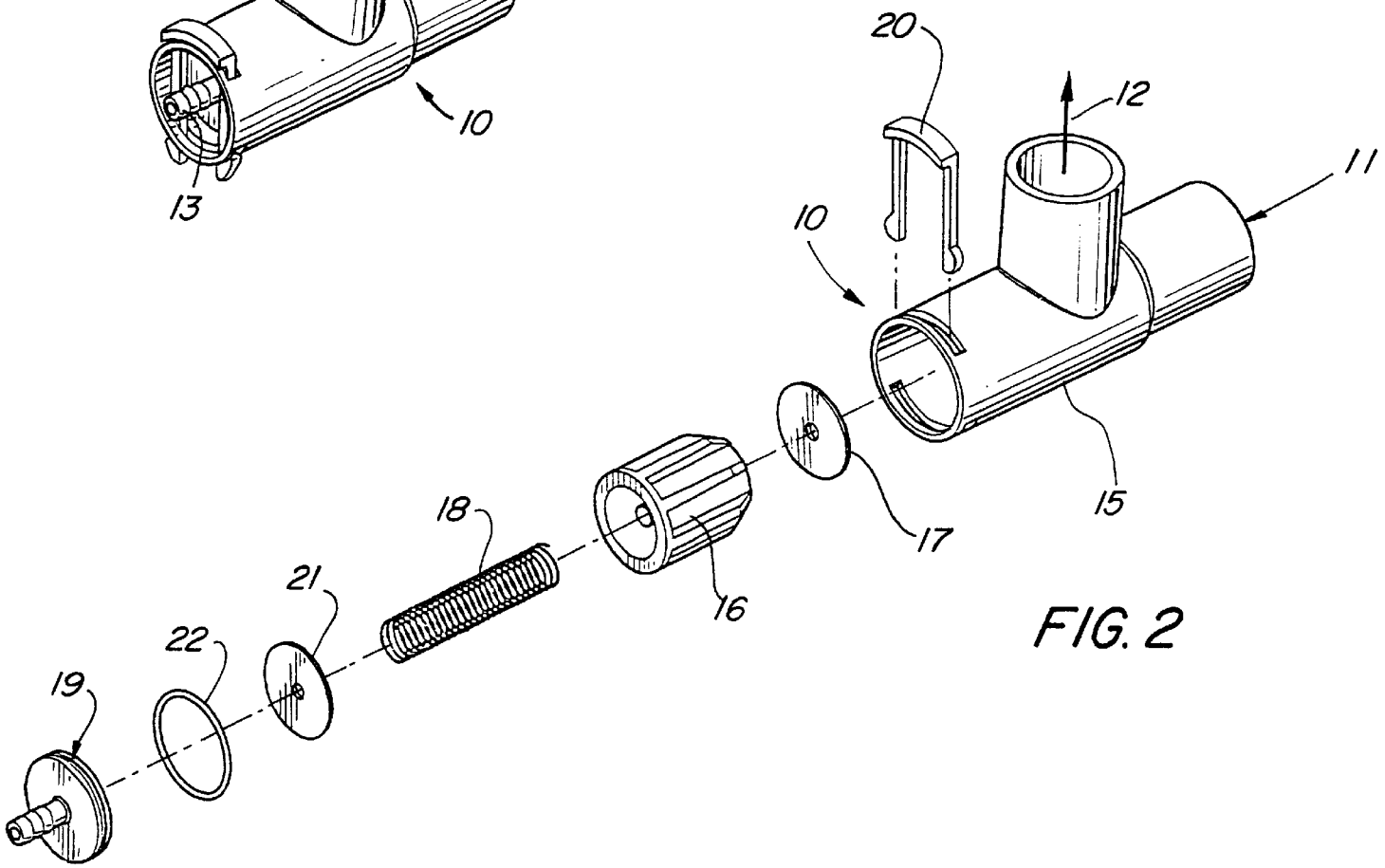
FIG. 2 is a n exploded-perspective view of the valve of the present invention.

Referring now to FIG. 2, an exploded-perspective view of the valve 10 is shown with all its constituent parts illustrated. The valve 10 includes a main housing 15 and a vacuum body 16, which moves within the main housing to open and close the valve. A diaphragm 17 is attached to the inner side of the body 16. A spring 18 biases the body 16 in a closed position, and the spring is held in place by an inlet port 19 and a clip retainer 20. A second diaphragm 21 and an O-ring 22 are pressed against the inlet port 19 by the spring 18 for sealing the valve. When a vacuum of at least 40 to 50 inches of water is applied to the port 19, it overcomes the bias of the spring 18 and opens the valve. The constituent parts of the valve 10 and their working relationship will be more fully appreciated by reference to FIGS. 3A and 3B of the drawings.

Figure 3A:
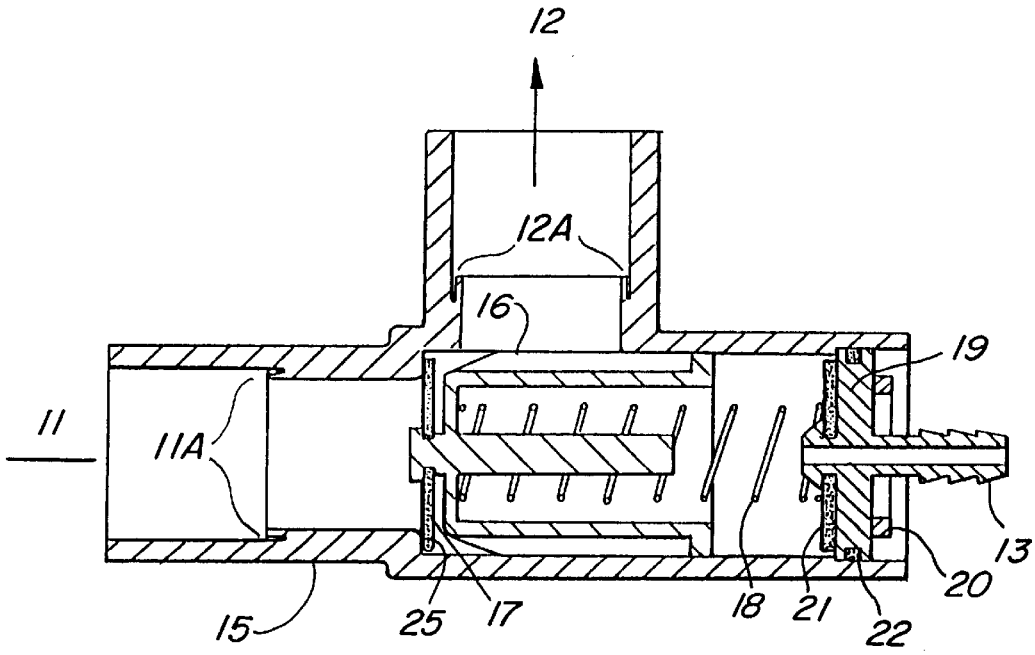
FIGS. 3A and 3B are cross-sectional views of the valve of the present invention in the closed and open position, respectively.

Referring now to FIG. 3A, a cross-sectional view of the valve 10 is shown in the closed position. Note that a glue trap 11A and 12A are provided within the intake 11 and outlet 12, respectively. Note also that the diaphragm 17 is seated on a step 25 inside the valve housing 15, and is held there under pressure from the spring 18. This position occurs when there is no vacuum applied to the inlet port 13. Accordingly, air applied at the intake port 11 will not pass to the exhaust port 12.

Figure 3B:
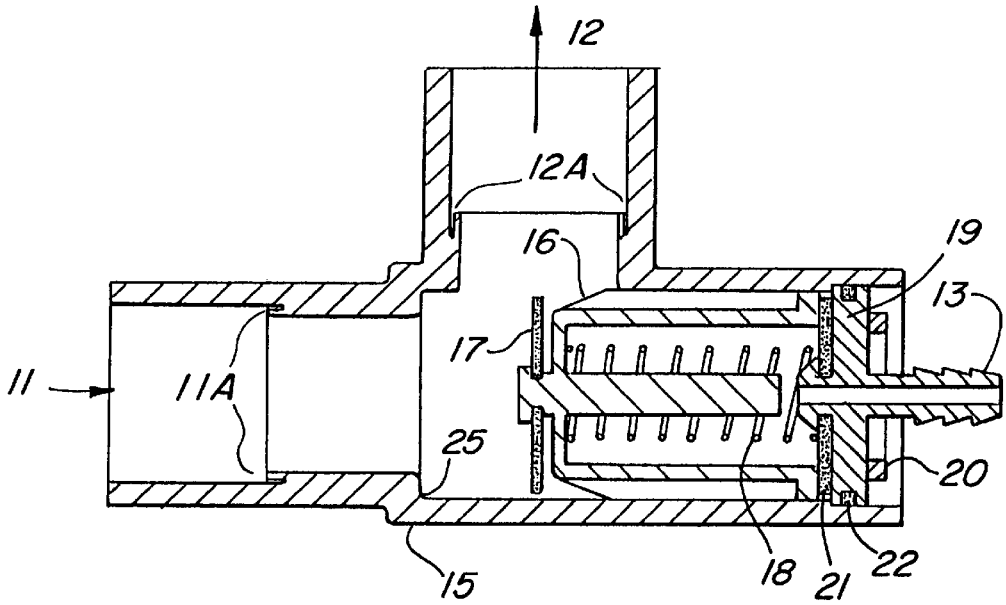

Referring now to FIG. 3B, a cross-sectional view of the valve 10 is shown in the open position. Note that the diaphragm 17 is now retracted away from the seat 25 due to a vacuum being applied to the inlet port 13. The vacuum applied must be sufficient to overcome the bias of the spring 18. Accordingly, air applied at the intake port 11 will now pass to the exhaust port 12.

Figure 4:
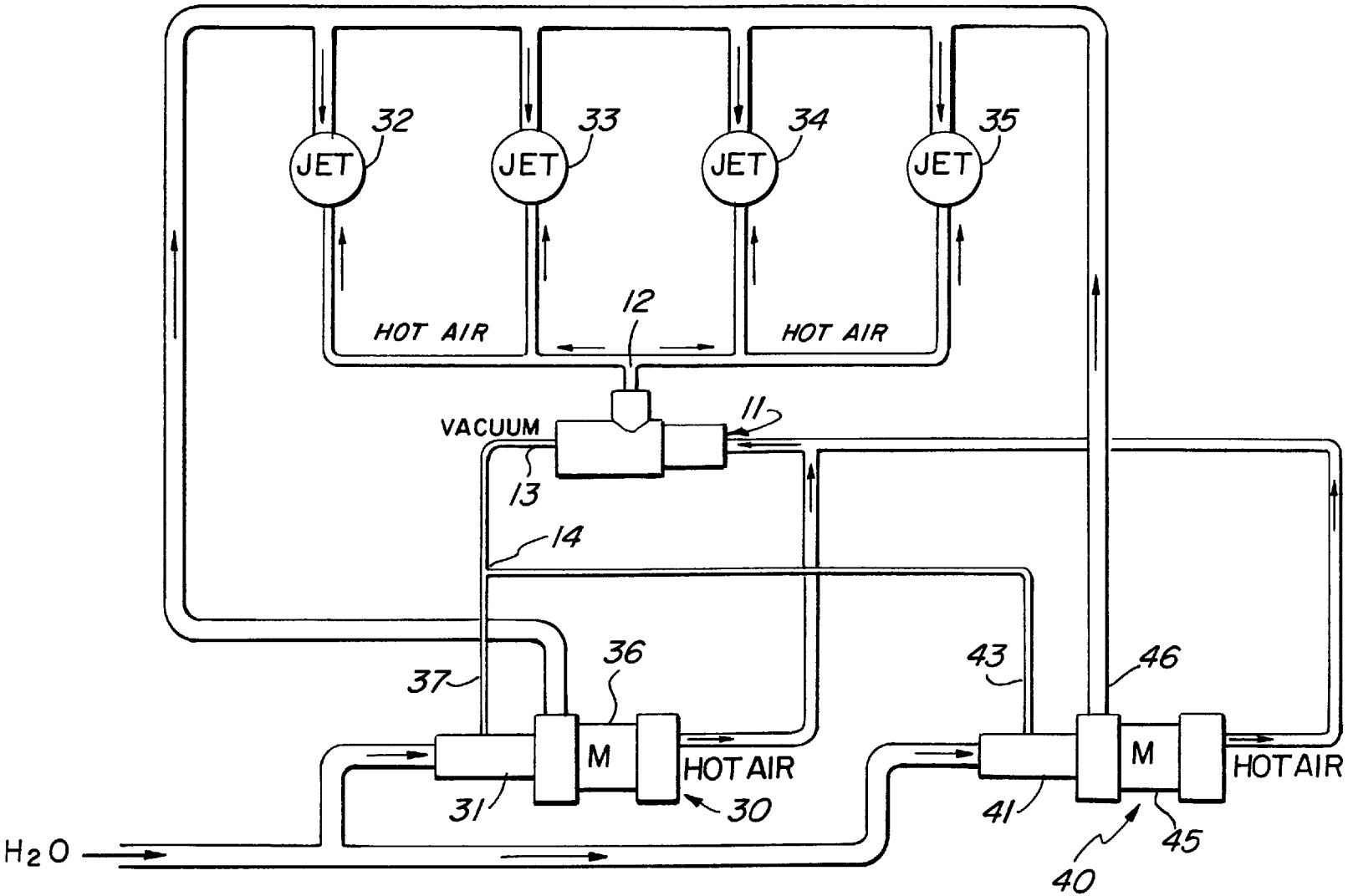
FIG. 4 is a schematic diagram of a part of a spa plumbing in which the valve of the present invention is useful.

Referring now to FIG. 4, a schematic diagram of a part of a spa plumbing in which the valve of the present invention is used is shown. A first water pump 30 receives water via an intake 31 and passes the water on to a series of jets 32, 33, 34, and 35. Even though only four jets are shown in this illustration, many more jets may be used in the same manner. The pump 30 is driven by a motor 36. A vacuum line 37 is also attached to the intake 31 of the pump 30, wherein a vacuum is created by a "Venturi" effect as water is taken in at the intake 31. The vacuum line 37 is coupled to the inlet port 13 of the valve 15 for operation thereof. In the illustrated embodiment, a second pump 40 is employed in parallel with the pump 30. The pump 40 also has an intake 41 and a vacuum line 43 attached thereto. Line 43 is coupled to the line 37 by means of a convention T connection 44. Pump 40 is driven by a motor 45 and also includes a water outlet 46, which is also coupled to the jets 32–35 in a similar manner as the pump 30.

Hot air is taken from the motors 36 and 45 and applied to the input of the valve 15. In this manner, the heat generated by the motors is used to warm the jets 32–35 without the need for a separate air heater. Accordingly, when the pumps 30 and 40 are operating and pumping water into the jets, a vacuum is created in the lines 37 and 43, which vacuum operates the valve 15 and lets the hot air exhaust from the motors 36 and 45 pass to the jets 32–35.

While the invention has been particularly shown and described with reference to a preferred embodiment, it will be understood by those skilled in the art that various changes in form and detail may be made therein without departing from the spirit and scope of the invention.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A system for use in a spa for controlling air flow to jets of said spa, said system comprising:

a. a water pump directing water to a water input of a jet nozzle;

b. a valve directing exhaust air from said water pump to an air input of said jet nozzle, said valve being operated by a vacuum generated at the intake of said water pump, whereby when said water pump is operating and pumping water to said jet nozzle, said valve is opened for directing said exhaust air from said water pump to said jet nozzle.

2. A system as in claim 1 wherein said valve comprises an air-check valve including a piston for closing said valve under spring pressure and being operative in response to a vacuum for overcoming said spring pressure so as to open said valve.

3. A system as in claim 2 wherein said piston is slotted thereby forming a debris multi-chamber for elimination of dirt build-up in said valve.

4. The system according to claim 2 wherein said piston is capable of rotating during each open/close cycle thereof, thereby preventing friction and the development of a wear pattern.

5. The system according to claim 2 wherein said valve comprises an air check valve with a vacuum chamber.

6. The system as in claim 1 including a second water pump coupled to said water inputs of said jet nozzles and having exhaust air therefrom added to exhaust air at said valve.

7. The system according to claim 1 wherein said valve comprises a positive sealing air check valve.

8. A system for use in a spa for controlling air flow to a multiplicity of jet nozzles of said spa, said system comprising:

a. a water pump directing water to a water input of each of said jet nozzles;

b. an air-check valve directing exhaust air from said water pump to an air input of each of said jet nozzles, said valve being operated by a vacuum generated at the intake of said water pump, whereby when said water pump is operating and pumping water to each of said jet nozzles, said valve is opened for directing said exhaust air from said water pump to each of said jet nozzles.

9. The system as in claim 8 wherein said air-check valve includes a piston for closing said valve under spring pressure and being operative in response to a vacuum for overcoming said spring pressure so as to open said valve.

10. The system as in claim 9 wherein said piston is slotted thereby forming a debris multi-chamber for elimination of dirt build-up in said valve.

11. The system according to claim 9 wherein said piston is capable of rotating during each open/close cycle thereof, thereby preventing friction and the development of a wear pattern.

12. The system according to claim 9 wherein said valve comprises an air-check valve with a vacuum chamber.

13. The system as in claim 8 including a second water pump coupled to said water inputs of said jet nozzles and having exhaust air therefrom added to exhaust air at said valve.

14. The system as in claim 8 wherein said valve comprises a positive sealing air check valve.

* * * * *